US007914352B2

(12) United States Patent
Williams

(10) Patent No.: US 7,914,352 B2
(45) Date of Patent: Mar. 29, 2011

(54) COVER FOR A FLOTATION DEVICE AND FLOTATION DEVICE EMPLOYING SAME

(75) Inventor: Margaret K. Williams, Lloyd Harbor, NY (US)

(73) Assignee: C2MP, Inc., Huntington, NY (US)

( * ) Notice: Subject to any disclaimer, the term of this patent is extended or adjusted under 35 U.S.C. 154(b) by 0 days.

(21) Appl. No.: 11/657,416

(22) Filed: Jan. 24, 2007

(65) Prior Publication Data

US 2008/0176467 A1 Jul. 24, 2008

(51) Int. Cl.
*B63C 9/08* (2006.01)

(52) U.S. Cl. ..... 441/129

(58) Field of Classification Search ..... 441/129–132; 150/154; 206/315.1; 280/814; 472/128, 472/129

See application file for complete search history.

(56) References Cited

U.S. PATENT DOCUMENTS

| | | | | |
|---|---|---|---|---|
| 1,236,694 | A | 8/1917 | Ellis | |
| 1,787,453 | A | 1/1931 | Murray | |
| 2,075,374 | A | 3/1937 | Tucker | |
| 3,420,022 | A | 1/1969 | Brock | |
| 3,526,564 | A | 9/1970 | Crawford | |
| 3,984,888 | A | 10/1976 | DeLano | |
| 4,136,478 | A * | 1/1979 | Wycosky | 43/26 |
| 4,624,877 | A | 11/1986 | Lea et al. | |
| 4,910,280 | A | 3/1990 | Robbins, III | |
| 4,973,278 | A | 11/1990 | Williams | |
| 5,022,572 | A * | 6/1991 | Brown | 224/437 |
| 5,028,468 | A | 7/1991 | Taylor | |
| 5,571,036 | A * | 11/1996 | Hannigan | 441/129 |
| 5,885,123 | A * | 3/1999 | Clifford | 441/129 |
| 5,991,945 | A | 11/1999 | Pang | |
| 6,085,695 | A * | 7/2000 | Miller et al. | 119/795 |
| 6,263,610 | B1 * | 7/2001 | Doubts, Jr. | 43/26 |
| 6,368,171 | B1 * | 4/2002 | Fuller et al. | 441/40 |
| 6,705,197 | B1 * | 3/2004 | Neal | 89/36.05 |
| 6,736,263 | B1 * | 5/2004 | Smith | 206/315.1 |
| 6,929,521 | B2 | 8/2005 | Howerton | |
| 6,971,133 | B2 * | 12/2005 | See | 5/706 |
| 7,008,281 | B2 | 3/2006 | Ketko | |
| 2002/0165516 | A1 * | 11/2002 | Datta et al. | 604/385.16 |
| 2004/0074008 | A1 | 4/2004 | Martens et al. | |
| 2004/0154941 | A1 * | 8/2004 | Montler | 206/320 |
| 2004/0206432 | A1 * | 10/2004 | Cirone | 150/154 |
| 2005/0153608 | A1 * | 7/2005 | Ketko | 441/130 |

FOREIGN PATENT DOCUMENTS

| | | |
|---|---|---|
| GB | 2108435 | 5/1983 |
| JP | 11-028170 | 2/1999 |
| JP | 11-206918 | 8/1999 |

OTHER PUBLICATIONS

"Sports & Leisure" UCP webpage http://www.ucp.org/ucp_channeldoc.cfm/1/15/11500/11500-11500/3168.
"Dow Ethafoam Polyethylene", Clark Foam webpage, http://www.clarkfoam.net/dowfoam.htm.

* cited by examiner

*Primary Examiner* — Ed Swinehart
(74) *Attorney, Agent, or Firm* — Dilworth & Barrese, LLP.

(57) ABSTRACT

A cover for a flotation device includes a single piece fabric configured and dimensioned so as to slip over and completely enclose an individual noodle type flotation device and adapted for removal and replacement by the same or another cover. The cover possesses reopenable closures such as drawstring, zipper, button, snap and/or hook and loop type closures at the ends of the cover or along its length.

10 Claims, 1 Drawing Sheet

COVER FOR A FLOTATION DEVICE AND FLOTATION DEVICE EMPLOYING SAME

FIELD OF THE INVENTION

The present invention relates to a cover for flotation devices, and more particularly to a cover for water flotation devices made of a buoyant polymer foam and the resultant covered water flotation device.

BACKGROUND OF THE ART

Flotation devices are known in the art. In particular, flotation devices popularly known as "noodles" are commonly used by bathers in swimming pools and at beaches. Noodles typically comprise elongated pieces of bare (uncovered) buoyant polymeric foam which help support the bather. Often produced in bright colors, the noodles are popularly used by both children and adults.

Hotels, resorts and health clubs often have a supply of such flotation devices for use by their guests. The devices are not discarded after one use but rather are stored for reuse by other guests. A problem associated with such reuse is that a device which has been in contact with the skin of one person is later placed into contact with the skin of another person, which is perceived by some users to be unsanitary. Moreover, some people find direct contact between bare polymeric foam and bare skin to be uncomfortable and/or they may be allergic to the foam. What is needed is a means for allowing multiple use of a flotation device such as the noodle while maintaining a sanitary and comfortable condition for all users.

Flotation devices using noodles are known in the art. For example, U.S. Pat. No. 5,885,123 to Clifford discloses a flotation device utilizing cylindrical foam tubes, or "noodles," inserted through sleeve(s) in the flotation device to provide a floating seat. U.S. Pat. No. 7,008,281 to Ketko discloses a flotation device utilizing at least two fabric covered foam noodles joined to provide a buoyant carrier for a baby seat, child/infant carrier or car seat. However, neither of these patents addresses or suggests a solution to the problems described above in connection with the use and/or reuse of buoyant foam flotation devices for users and multiple users.

SUMMARY OF THE INVENTION

A cover for a flotation device is provided herein. The cover is configured and dimensioned to removably slip over (i.e., slip on and off) and completely enclose an elongated cylindrical buoyant polymeric foam member (e.g., a noodle). The cover comprises a single piece, preferably of fabric, possessing reopenable closure means. Also provided herein is a flotation device enclosed within the cover of the present invention. The present invention allows for comfortable use of the flotation device while further providing a means for sanitary and comfortable conditions for multiple use of the flotation device by different subsequent users.

BRIEF DESCRIPTION OF THE DRAWINGS

Various embodiments are described below with reference to the drawings wherein.

DETAILED DESCRIPTION OF PREFERRED EMBODIMENT(S)

Figure 1:
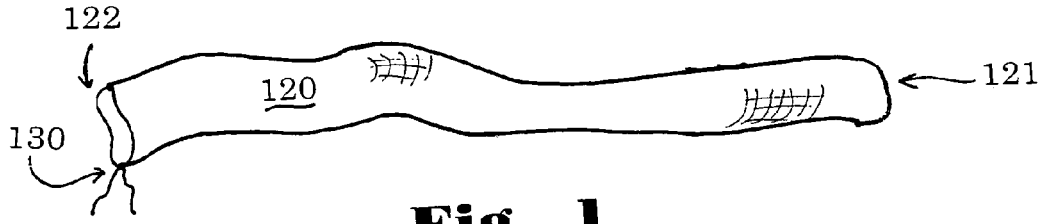
FIG. 1 illustrates an embodiment of the flotation device cover of the invention.
Figure 3:
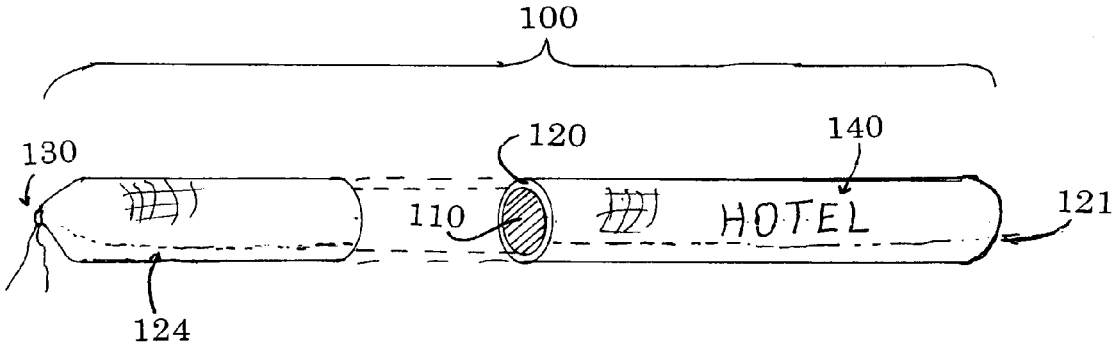
FIG. 3 is a partially cut away perspective view of a flotation device assembly including a noodle type flotation device enclosed in the cover of the invention.

Referring now to FIGS. 1 and 3, in one embodiment the present invention includes a cover 120 for a flotation device. Cover 120 is configured and dimensioned to removably slip over a noodle type flotation device like a sheath or sleeve to provide a flotation device assembly 100. The noodle type flotation device is preferably completely enclosed by the cover 120. The flotation device assembly 100 shown in FIG. 3 includes an elongated preferably cylindrical member 110 of buoyant material, particularly a closed cell polymeric foam. A polymeric foam suitable for use in flotation devices is commercially available under the designation ETHAFOAM® from Dow Chemical Co. Such polymeric foam members are well known in the art and are typically known as "noodles" for use by bathers for example in swimming pools and at beaches. The term "noodle" as used herein refers to such a flotation device. The noodle 110 is typically about 2 to 3 inches in diameter and about 4 to 6 feet in length.

Figure 2:
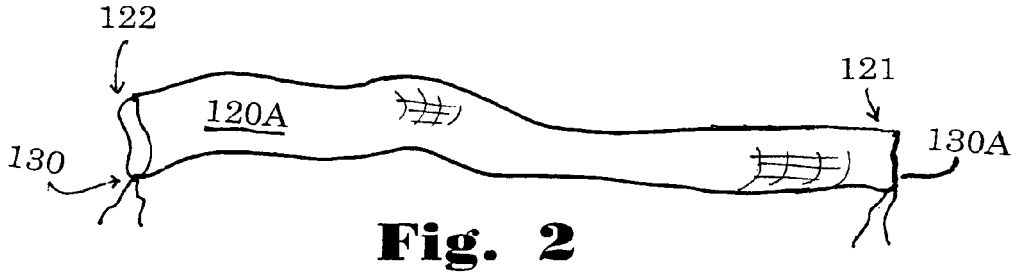
FIG. 2 illustrates an alternative embodiment of the invention.
Figure 4:
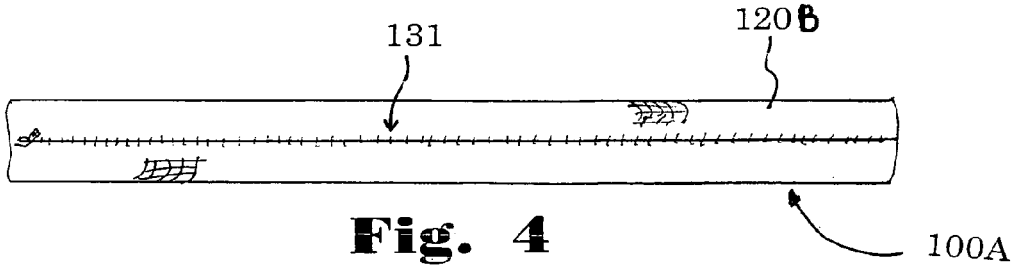
FIG. 4 is a plan view illustrating an alternative embodiment of the invention.

The cover 120 includes at least one reopenable closure means 130. FIG. 1 illustrates an embodiment wherein the cover 120 includes a closed first end 121, and an opposite open second end 122 having a reopenable closure means comprising a drawstring 130 disposed through an annular channel at the end 122 of the cover formed by bending over and sewing the edge of the cover material. FIG. 2 illustrates an alternative cover 120A having reopenable drawstring closures 130 and 130A, each at a respective one of the two opposite open ends of the cover 120A. Alternatively, as shown in FIG. 4, a flotation device assembly 100A includes a cover 120B with a zipper type closure 131, preferably fabricated from plastic, extending at least partially along the length of the cover 120B. Reopenable closure means suitable for use in the invention, in addition to the drawstring or zipper, can include, for example, a button system, a snap system, or a hook and loop type closure typically sold under the trademark VELCRO®.

A feature of the invention is the use of an outer cover 120 which is removable and replaceable. The outer cover 120 optionally can be sanitized and reused or, alternatively, discarded and replaced by a new and unused cover. The cover 120 can be fabricated from any material suitable for the purposes described herein. In an embodiment of the invention the outer cover 120 is fabricated from single piece cotton cloth, polyester, nylon, LYCRA® brand synthetic fiber or other type fabric material sewn, preferably with edges joined along a lengthwise extending seam 124 (FIG. 3), into a shape configured and dimensioned to slip on and off and preferably completely enclose an individual noodle 110. The cover 120 is preferably quick drying and shrink proof and moreover stretchable so as to be easily slipped over the noodle 110 and to closely conform to the shape of the noodle upon insertion thereof. In an embodiment of the invention cover 120 is slightly longer than the noodle so as to provide fabric material to cover the end surface of the noodle 110.

Optionally, the cover 120 can be colored and/or can include a pattern or design to facilitate recognition or to be aesthetically pleasing. In an embodiment the cover 120 can be colored with a fluorescent dye to enhance visibility. Also, the cover 120 can optionally include indicia 140 printed on the exterior surface thereof, for example, to advertise the name of the establishment providing the flotation devices 100, or other type advertisement, information or graphics. Moreover, the cover 120 can be treated so as to be microbial resistant or can be fabricated from a microbial resistant fabric.

Typically, an establishment such as a hotel, resort or health club having swimming facilities such as a swimming pool or access to a beach, will have on hand multiple flotation devices for use by the guests. The establishment can provide one or more noodles 110 for common use by the guests, as well as individual sanitary covers 120, for personal use by an individual guest. Alternatively, a user can purchase the sanitary cover 120 for personal use on the flotation device. After use, the cover 120 can be removed and either replaced by a new cover, discarded or reused. Preferably, the used cover is dried, sanitized, for example, by applying a disinfectant thereto or by washing, and reused as a sanitary cover.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A flotation device assembly consisting of:

a) a single elongated cylindrical polymeric foam noodle flotation device; and b) a removable and replaceable cover configured and dimensioned to enclose and closely conform to the shape of said noodle flotation device, wherein said cover consists of a stretchable single layered fabric material having a uniform, unclad outer surface disposed about a circumference of the device, said fabric material having edges joined along a longitudinally extending seam and said cover including at least one reopenable drawstring closure positioned at one of two opposite ends of said cover and disposed within an annular channel in said cover.

2. The flotation device assembly of claim 1 wherein said cover is a sanitary cover.

3. The flotation device assembly of claim 1 wherein the cover is quick drying and shrink proof.

4. The flotation device assembly of claim 1 wherein the cover is treated to be microbially resistant.

5. A flotation device assembly consisting of:

a) a single elongated cylindrical polymeric foam noodle flotation device; and b) a removable and replaceable cover configured and dimensioned to enclose and closely conform to the shape of said noodle flotation device, wherein said cover consists of a stretchable single layered fabric material having a uniform, outer surface disposed about a circumference of the device, said fabric material having edges joined along a longitudinally extending seam and said cover possessing at least one reopenable drawstring closure positioned at a respective one of two opposite ends of the cover and disposed within an annular channel in the cover, wherein said outer surface is unclad except for indicia disposed thereon.

6. The flotation device assembly of claim 5 wherein said cover is a sanitary cover.

7. A method for providing a sanitary flotation device assembly comprising the steps of:

a) providing a removable and replaceable sanitary cover configured and dimensioned to enclose and closely conform to the shape of a polymeric foam noodle flotation device, wherein said cover consists of a stretchable single layered fabric material having a uniform, unclad outer surface disposed about a circumference of the device, said fabric material having edges joined along a longitudinally extending seam and said cover including at least one reopenable drawstring closure positioned at one of two opposite ends of said cover and disposed within an annular channel in said cover;

b) inserting the polymeric foam noodle flotation device into the removable and replaceable sanitary cover; and, c) closing the at least one drawstring closure.

8. The method of claim 7 further comprising:

removing the removable and replaceable cover from the polymeric foam noodle flotation device after it has been used, sanitizing the removable and replaceable cover, and inserting a polymeric foam noodle flotation device into said sanitized removable and replaceable cover.

9. A method for preventing skin discomfort and/or allergic effects caused by contact of the skin of a person with a bare polymeric foam noodle flotation device, comprising:

a) providing a removable and replaceable cover configured and dimensioned to enclose and closely conform to the shape of said noodle flotation device, wherein said cover consists of a stretchable single layered fabric material having a uniform, unclad outer surface disposed about a circumference of the device, said fabric material having edges joined along a longitudinally extending seam and said cover including at least one reopenable drawstring closure positioned at one of two opposite ends of said cover and disposed within an annular channel in said cover;

b) inserting a polymeric foam noodle flotation device into the removable and replaceable cover; and, c) closing the at least one drawstring closure.

10. The method of claim 9 further comprising:

removing the removable and replaceable cover from the polymeric foam noodle flotation device after it has been used, sanitizing the removable and replaceable cover, and inserting a polymeric foam noodle flotation device into said sanitized removable and replaceable cover.

* * * * *